United States Patent [19]

Doilov et al.

[11] 4,007,093

[45] Feb. 8, 1977

[54] FURNACE FOR THERMAL PROCESSING OF LUMP SOLID FUEL

[76] Inventors: Svyatoslav Kirillovich Doilov, ulitsa Kalevi, 23, kv. 25; Viktor Mikhailovich Efimov, ulitsa Vyidu, 4, kv. 5; Rikhard Eduardovich Ioonas, ulitsa Ametijukhingu, 7, kv. 25; Nikolai Andreevich Nazinin, ulitsa Vyidu, 12, kv. 30; Enn Edgarovich Piik, Narvskoe shosse, 53, kv. 2, all of Estonskaya SSR, Kokhtla-Yarve; Khans Eduardovich Raad, ulitsa Hyukogude, 42, kv. 24, Estonskaya SSR, Kiviyli; Ivar Kharaldovich Roox, ulitsa Komsomoli, 27, kv. 24; Nikolai Dmitrievich Serebryannikov, ulitsa Lauristini, 5, kv. 17, both of Estonskaya SSR, Kokhtla-Yarve; Jury Vasilievich Shaganov, ulitsa Soo, 13, kv. 10, Estonskaya SSR, Kiviyli; Leonid Semenovich Ananiev, ulitsa Komsomoli, 15, kv. 12; Alexei Sergeevich Volkov, ulitsa Aia, 7, kv. 5, both of Estonskaya SSR, Kokhtla-Yarve, all of U.S.S.R.

[22] Filed: Apr. 30, 1975

[21] Appl. No.: 573,009

[52] U.S. Cl. ..... 202/121; 48/69; 202/221; 202/229; 202/262; 202/269; 201/34; 201/44

[51] Int. Cl.[2] ..... C10B 35/00; C10B 39/04; C10B 49/06; C10J 3/72

[58] Field of Search ..... 196/123; 201/34, 37, 201/44; 202/121, 221, 229, 261, 262, 269; 48/69

[56] References Cited

UNITED STATES PATENTS

| | | | |
|---|---|---|---|
| 1,177,584 | 3/1916 | Wallmann | 202/262 X |
| 1,207,019 | 12/1916 | Glover et al. | 202/269 X |
| 1,414,109 | 4/1922 | Blass | 48/69 |
| 2,026,923 | 1/1936 | Warner | 201/34 X |
| 2,167,503 | 7/1939 | Gilles | 202/221 |
| 3,464,913 | 9/1969 | Berry | 201/34 X |
| 3,475,319 | 10/1969 | MacLaren | 201/34 X |
| 3,841,992 | 10/1974 | Jones, Jr. et al. | 201/34 X |

OTHER PUBLICATIONS

German patent application 03213, IVc/26a, July 5, 1956.

*Primary Examiner*—Morris O. Wolk
*Assistant Examiner*—Michael S. Marcus
*Attorney, Agent, or Firm*—Lackenbach, Lilling & Siegel

[57] ABSTRACT

A furnace for thermal processing of lump solid fuel, comprising a body accommodating a semicoking zone, zones for gasifying semicoke and for cooling waste solid material and chambers adapted for feeding gas into said zones and discharging a vapor-gas mixture therefrom, said zones and chambers being arranged in succession along the height of the furnace body. The furnace is furnished with an unloading device for discharging solid waste material, said device being located in the bottom part of the furnace body and constituting a hopper with a water seal having a cylindrical bottom passing into a sloping trough. Mounted above the cylindrical portion of the bottom is a sector rocking-type pusher and above the sloping trough - a mechanical shovel associated with the sector pusher in such a manner that a working stroke of the sector pusher corresponds to an idle stroke of the mechanical shovel.

15 Claims, 2 Drawing Figures

FURNACE FOR THERMAL PROCESSING OF LUMP SOLID FUEL

The present invention relates to thermal processing of solid fuels and more particularly to furnances for thermal precessing of lump solid fuel. The furnance of the invention may prove to be most advantageous in processing oil shales.

Known in the art is a furnance for thermal processing of lump solid fuel, namely, oil shales, wherein its semicoking is effected in a horizontal-transverse flow of a gaseous heat carrier. The top portion of the furnace accommodates a semicoking zone, comprising a vertical shale distillation chamber, a chamber for preparing and distributing the heat carrier in the semicoking zone (a hot chamber) and a chamber for collecting and discharging a vapor-gas mixture (a cold chamber). The furnance bottom portion houses a semicoke gasifying zone and a waste residue cooling zone. The process is carried out in an ascending flow of a gasifying agent supplied into the gasifying zone.

The shales are charged by means of a loading device into the top portion of the shale distillation chamber where they are subjected to semicoking under the effect of the heat carrier at a temperature of 600°–900° C. The heat needed for the process is obtained both by burning a fraction of a circulation gas in the hot chamber and due to the gasification of semicoke in the bottom part of the furnance. The vapor-gas mixture passes from the shale distillation chamber to the cold furnance chamber from which the mixture at a temperature of 150°–200° C is led via a gas duct, located in the top portion of the cold chamber, to a condensing system.

Waste solid material is discharged from the bottom part of the furnance by an unloading device and is dumped. The unloading device comprises a bowl rotating in a spherical bearing and accommodating the bottom part of the furnance body lowered therein, with the being brought into rotation by means of a mechanical drive through a worm gearing. The bowl, whose bottom portion mounts a fire grate and a distributor head, is filled with water to establish a water seal. The bottom part of the furnance body, immersed into the bowl, carries scraper knives welded thereto. As the bowl is rotating, the solid material being discharged climb along the scraper knives-plough shares and is poured into an adjacent hopper terminating with a spout. The waste solid material is handled along the spouts to conveyor belting to be removed from the shop.

A serious disadvantage of the prior-art furnace resides in its comparatively low output which does not exceed 200 *t* of shales per 24 hours, with the furnaces of the above type requiring thereby a considerable floor areas for their allocation. One of the main reasons, precluding the achievement of high shale throughput with the known furnaces, is a low efficiency of their unloading devices. The latter have low-height (300–400 mm $H_2O$) water seals, which does not enable the furnance to operate at forced-blast duties, and a restricted bowl rpm which cannot provide the discharge of large quantities of waste solid material. The use of higher water seals with the existing unloading devices is a matter of serious technical difficulties, since it would call for an increase in the bowl height, a feature which would complicate immensely the solution of the problem of discharging waste solid material from the bowl. Any considerable increase in the rate of rotation of the bowl is also impractical owing to its combersome nature. But even if one succeeds in solving this problem, withdrawal of solid residue from the bowl would present serious difficulties, since it would cause a decrease in frictional forces between the internal walls of the bowl and the solid residue, and the material would not climb along the scraper knives.

Rotatable bowls are characterized by a sophisticated design, they are too cumbersome and as shown by experience, fail to provide a uniform motion of the processed shales along the furnace cross-section, the latter resulting in incomplete semi-coking and in a lower thermal efficiency of the process. Moreover, the above-described unloading devices suffer from another disadvantage, i.e. a comparatively large water requirements for creating a water seal, a considerable amount of water being entrained by unloaded material. This adversely affects the transportability of the waste solid material.

And, finally, the rotating bowls, owing to their intricate design and bulky nature, are absolutely inapplicable for high-production furnaces with semicoking shafts accommodating a plurality of shale distillation chambers.

The main object of the invention is the provision of a furnace for thermal processing of lump solid fuel which would feature a high output in terms of processed solid material and would require a comparatively small floor area for its allocation.

Another object of the invention is to provide a furnace ensuring a higher process thermal efficiency.

Still another object of the invention is to provide a furnace with an unloading device which would be simple in design and reliable in operation.

Yet another object of the invention is the provision of a furnace with an unloading device which would offer an easy automation and control of the solid fuel processing technique.

These objects are accomplished in a furnace for thermal processing of lump solid fuel, comprising a body accommodating a semicoking zone, those for gasifying semicoke and for cooling waste solid material, and chambers adapted for supplying gas into said zones and for discharging a vapor-gas mixture therefrom, said zones and chambers being arranged in succession along the height of the furnace body, a loading device for charging solid fuel into the top portion of the body and an unloading device for discharging waste solid material from its bottom part, wherein, according to the invention, the unloading device is a hopper tapering downwards, having a water seal with a cylindrical bottom passing into a sloping trough in the zone of exit of the solid waste material from the water seal, and furnished with a sector rocking-type pusher mounted above the cylindrical portion of the water seal bottom, and with a mechanical shovel disposed above the sloping trough and linked mechanically with the sector pusher so that a working stroke of the sector pusher corresponds to an idle stroke of the mechanical shovel, with both the sector pusher and mechanical shovel being coupled with hydraulic rams.

It is expedient that the kinematic linkage between the sector pusher and mechanical shovel be effected by means of a rod articulated thereon, with the rod length being selected so that the mechanical shovel, shifted to an extreme position during its working stroke, does not reach an exit edge of the sloping trough.

The inherent design of the unloading device ensures the discharge of the processed material from the furnace with a high water seal, 1000 mm $H_2O$ in height. This would create favourable conditions for processing solid material, such as, shales, at forced-draft duties, with the shale throughout exceeding 1000 t per 24 hours. A uniform descending motion of the processed material in the furnace ensuing from a regular discharge of the waste solid material enables a more uniform heating of the shales in the semicoking shaft and, hence, offers an increase in the process thermal efficiency.

The unloading device proper is characterized by a simple design and high functional reliability by which virtue it can be employed in furnaces with several shale distillation chambers in their semicoking shafts. A possibility of varying the operating rate of its mechanisms in a wide range facilitates materially the solution of a whole range of problems associated with the process automation. The presence in the unloading device of the sloping trough, which makes it possible to return a certain amount of water entrained by the discharged material into the water seal, diminishes water requirements for creating a permanent water seal.

As a result, the cost of tar produced in processing shales in the proposed furnaces will be 20–25% lower and operating efficiency 3–4 times higher.

The nature of the invention will be clear from the following detailed description of a particular embodiment to be had in conjunction with the accompanying drawings, in which.

Figure 1:
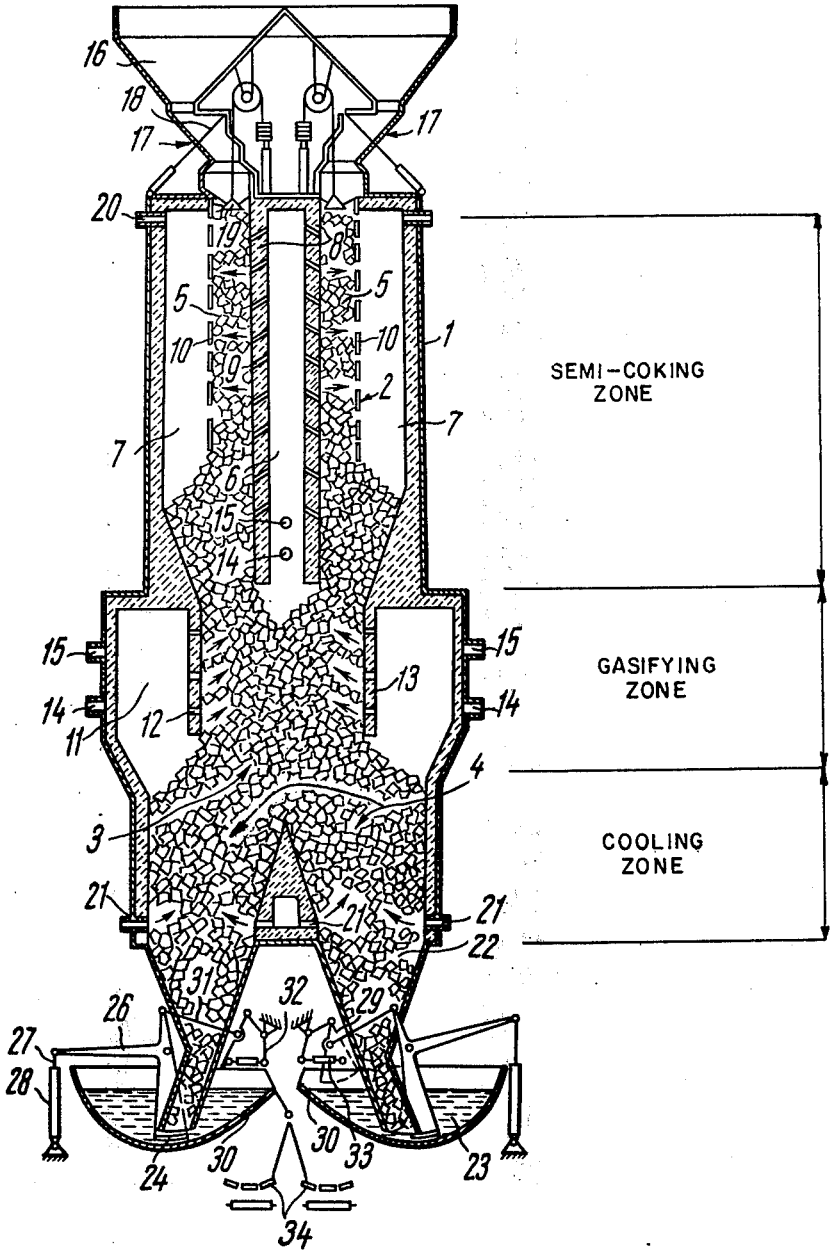
FIG. 1 is a schematic drawing of a furnace for thermal processing of lump solid fuel, according to the invention (a cross-sectional view)

A furnace for thermal processing of solid fuel, oil shales, in particular, comprises a body 1 (FIG. 1) accommodating a semicoking zone 2, a semicoke gasifying zone 3 and a zone 4 for cooling solid waste material, arranged in succession along the height of the furnace body 1. The semicoking zone 2 houses two shale distillation chambers 5, this necessitating the use of two unloading devices. However, the furnace may have only one shale distillation chamber and in that case one unloading device will, naturally, suffice.

The furnace has a chamber 6 (a hot chamber) for preparing and distributing a heat carrier in the semicoking zone 2, and chambers 7 (cold chambers) for collecting and discharging a vapor-gas mixture. The chamber 6 is separated from the chambers 5 by vertical walls 8 of a refractory material, fitted with spray nozzles 9 for the passage of a heat carrier. The chambers 7 are also separated from the chambers 5 by means of metallic gratings 10. Side chambers 11 with spray nozzles 12 located in a refractory wall 13 are adapted for introducing a gasifying agent or a heat carrier into the semicoke gasifying zone 3. The chambers 6 and 11 are furnished with gas burners 14 and devices 15 for feeding a circulation gas.

Shales are charged into the furnace from hoppers 16 by automatic loading devices 17 having each a gate valve 18 in its top portion and a pendant cone 19 located in its bottom part and separating the loading device 17 from the top portion of the shale distillation chamber 5, both of them - the gate valve 18 and the pendant cone 19 - being adapted to provide a proportionate supply of the shales being loaded. The vapor-gas mixture is removed from the furnace through gas ducts 20.

The zone 4 for cooling waste solid material accommodates devices 21 for injecting a cooled circulation gas, and two unloading devices for discharging the waste solid material.

The unloading device constitutes a hopper 22 that is tapering downwards and is immersed into a water seal 23 so that it is arranged above a cylindrical seal bottom with a certain clearance therebetween. In this clearance travels a sector rocking-type pusher 24 (FIGS. 1 and 2) articulated from side walls 25 (FIG. 2) of the water seal 23. The length of the sector pusher 24 and of an opening in the hopper 22 are selected to conform to the furnace size.

Arms 26 of the sector pusher 24 are articulated with connecting rods of two main hydraulic rams 28.

The sector pusher 24 is linked mechanically with a mechanical shovel 29 mounted above a sloping trough 30 into which passes the cylindrical bottom of the water seal 23 in the zone of exit of the solid material from the water seal 23. The kinematic linkage between the sector pusher 24 and mechanical shovel 29 is accomplished with the help of a rod 31 articulated therewith, with the rod length being selected so that the mechanical shovel 29, shifted to an extreme position during its working stroke, does not reach an exit edge of the sloping trough 30. This provides an efficient dewatering of the waste solid residues.

The mechanical shovel 29 is articulated on two levers 32 lifting it during its idle stroke. Hoisting is effected by means of two auxiliary hydraulic rams 33. All the hydraulic rams 28 and 33 are connected in parallel and selected so that the pressure needed to raise and lower the mechanical shovel 29 is always less than that required for transferring the sector pusher 24. The sloping trough 30 is set up above a conveyor 34.

Figure 2:
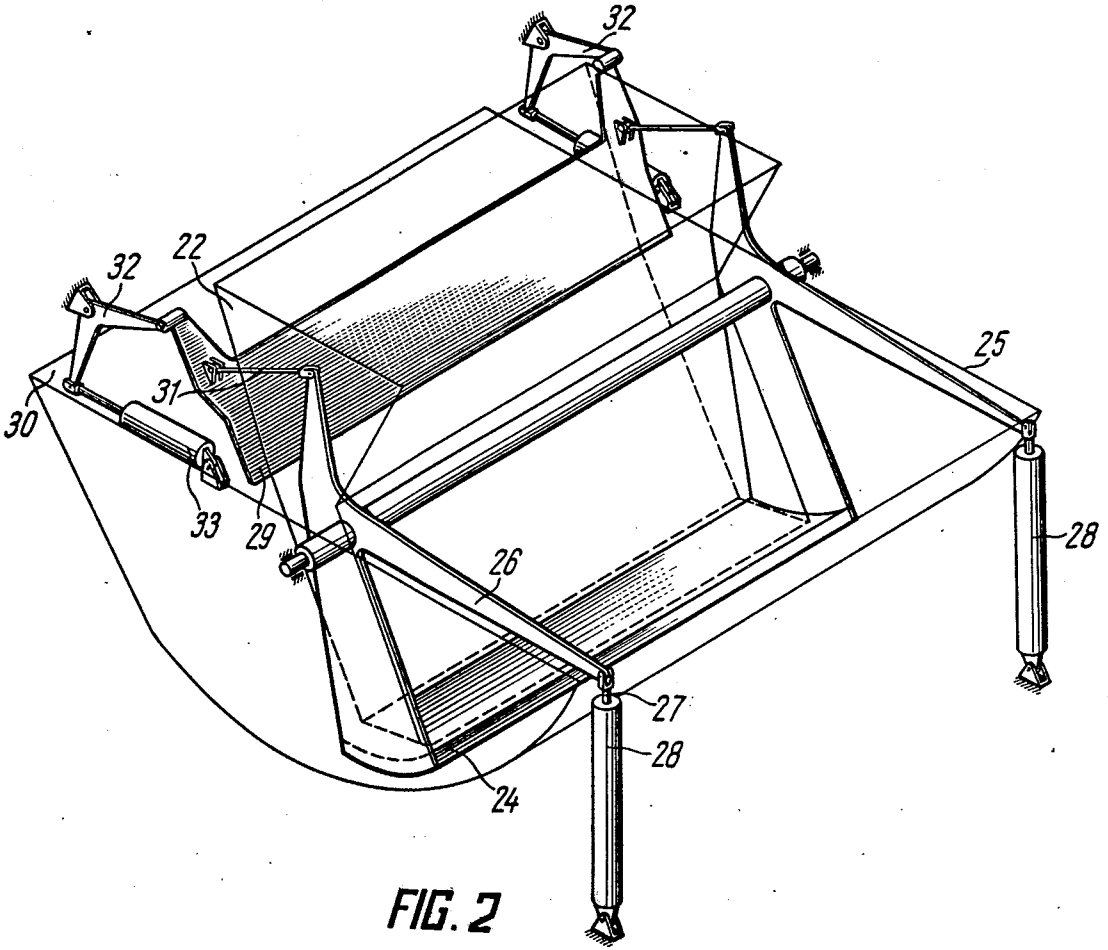
FIG. 2 is a scaled-up drawing of an unloading device, according to the invention.

FIG. 2 shows the location of all the members of the unloading devices at the end of a working stroke of the sector pusher 24.

The herein-proposed furnace for thermal processing of solid fuel, oil shales, in particular, operates in the following manner.

The loading device 17 supplies lump shales from the hoppers 16 (FIG. 1) into the chambers 5 where they are heated in a flow of a gaseous heat carrier, introduced at a temperature of 600°–900° C from the chamber 6 through nozzles 9 in vertical walls 8 and passing transversely through a layer of the shales. The heat carrier is partly obtained by burning the circulation gas in the bottom space of the chamber 6 fitted for that purpose with burners 14 and gas feeding devices 15. Another fraction of the heat carrier is supplied from the gasifying zone 3.

The gaseous heat carrier flows from the chambers 5 together with volatile semicoking products into the chambers 7 and at a temperature of not more than 150°–200° C it is drawn off via gas ducts 20. The semicoke proceeds further to the zone 3 for gasifying or additional heating owing to the introduction of an appropriate gasifying agent (a steam-air, gas-air or smoke-air mixture or possibly flue gases) or of a heat carrier (a mixture of flue gases with a cooled circulation gas) supplied from the side chambers 11 fitted with the burners 14 and circulation gas feeding devices 15 and, if necessary, with inlets for supplying steam (not shown in FIG. 1).

Gas flows are led from the zone 3 both to the chamber 6 and chambers 7 ensuring a uniform heating of the material. Most favourable working conditions in the zone 3 are selected experimentally.

Waste solid material is delivered from the zone 3 into the zone 4 where it is cooled to a temperature of 80°–100° C by the circulation gas fed through the devices 21, and is discharged from the furnace by the unloading device.

The unloading device functions as follows.

At a reversal from a working to an idle stroke a pressure is built up in rodless spaces of the main hydraulic rams 28 and auxiliary rams 33 (FIG. 2). As the pressure needed for lowering the mechanical shovel 29 is lower than that for transferring the sector pusher 24, the mechanical shovel 29 drops down and caves in the material being discharged. After the mechanical shovel 29 has descended, the pressure in the hydraulic system increases, the hydraulic rams 28 are actuated and the sector pusher 24 shifts in a direction opposite to the sloping trough 30, with the mechanical shovel 29 loading a batch of material thereon (on the trough 30). Since the mechanical shovel 29 does not reach the exit edge of the sloping trough 30, an efficient dewatering of the material left on the trough 30 is provided.

The mechanical shovel 29 directs the motion of the material being discharged in the top portion of the water seal 23, restricts the material level, decreasing thereby its resistance to the ejection from under the outlet of the hopper 22.

As the material travels along the sloping trough 30, excess water flows back into the water seal 23 and the processed and dewatered material is pushed onto the conveyor 34 during the next stroke of the mechanical shovel 29.

At the end of an idle stroke of the sector pusher 24 a reversal takes place, whereafter the pressure is built up in the rod spaces of the main hydraulic rams 28 and auxiliary rams 33. For the same reason, as in the first case, the mechanical shovel 29 is first to go up, whereafter the sector pusher 24 shifts towards the sloping trough 30 ejecting the next batch of the discharged material, and the cocked mechanical shovel 29 moves to the centre of the water seal 23.

In operation all the members of the unloading device are coupled in such a manner that a working stroke of the sector pusher 24 corresponds to an idle stroke of the slightly raised mechanical shovel 29 and, vice versa, during an idle stroke of the sector pusher 24, the lowered mechanical shovel 29 performs its working stroke. The above coupling decreases substantially the resistance during each stroke.

The throughput cpacity of the unloading device is adjusted by a throttle included in a drive hydraulic circuit (not shown in the drawing). The latter enables the speed of operation of the individual members of the unloading device to be varied steplessly and over a wide range. This creates favourable conditions for the automatic regulation of thermal processing in the proposed furnace.

What we claim is:

1. A furnace for thermal processing of solid fuel, comprising: a generally hollow body, a first chamber portion located generally at the top of said body and defining a semicoking zone and including at least one gas distillation chamber, a second chamber portion located generally in the lower region of said body and defining a cooling zone, and a third chamber portion generally intermediate said first and second chamber portions and defining a gasifying zone; gas feeding chambers within said body adapted for feeding gas into said semicoking and gasifying zones; a vapor-gas mixture chamber within said body adapted to discharge vapor-gas mixture from said gas distillation chamber; a loading device for charging solid fuel into said first chamber portion of said body; and an unloading device for discharging the solid waste material from said second chamber portion of said body, said unloading device comprising hopper means below said second chamber portion, water seal means for said hopper means, said water seal means having a bottom surface portion, pusher means located above said bottom surface portion of said water seal means and mounted thereto for at least partial movements along said bottom surface portion for advancing waste materials discharged by said hopper means into said water seal means to a discharging zone of said water seal means, first means for operating said pusher means, shovel means disposed generally in said discharging zone, and second means for moving said shovel means so that it shovels the waste material off said bottom surface portion of said water seal means, said pusher means and shovel means being arranged so that said pusher means is generally in its operative mode when said shovel means is generally in its idle condition.

2. A furnace for thermal processing of solid fuel as defined in claim 1, wherein said shovel means is mechanically linked to said pusher means so as to substantially decrease the resistance during each stroke or cycle of said unloading device.

3. A furnace for thermal processing of solid fuel as defined in claim 1, wherein said first means for operating said pusher means includes at least one hydraulic ram or cylinder.

4. A furnace for thermal processing of solid fuel as defined in claim 1, wherein said second means for operating said shovel means includes at least one hydraulic ram or cylinder.

5. A furnace for thermal processing of solid fuel as defined in claim 1, wherein pairs of hydraulic rams or cylinders cooperate with and operate said pusher and shovel means.

6. A furnace for thermal processing of solid fuel as defined in claim 1, wherein two gas distillation chambers are provided within said semicoking zone.

7. A furnace for thermal processing of solid fuel as defined in claim 1, wherein said gas feeding chambers are separated from said gasifying zone by means of walls provided with spray nozzles.

8. A furnace for thermal processing of solid fuel as defined in claim 1, wherein said vapor-gas mixture chamber is separated from said at least one gas distillation chamber by means of gratings.

9. A furnace for thermal processing of solid fuel as defined in claim 1, further comprising conveyor means disposed generally below said discharging zone for carrying away the waste materials from the region of the furnace upon being discharged from said discharging zone by said shovel means.

10. A furnace for thermal processing of solid fuel as defined in claim 1, wherein said hopper means includes two downwardly diverging portions having spaced discharging ends, and two water seal means and unloading devices are provided each associated with another one of said two diverging portions.

11. A furnace for thermal processing of solid fuel as defined in claim 1, wherein said water seal means has a cylindrical bottom surface portion which turns into a sloping trough in said discharging zone, and said pusher means comprises a rocking-type sector pusher generally located above said cylindrical bottom portion of said water seal means, and said shovel means is generally located above said trough portion.

12. A furnace for thermal processing of solid fuel as defined in claim 11, wherein pairs of hydraulic rams or cylinders cooperate with and operate said pusher and shovel means, and wherein said pusher means comprises a sector-type structure having at least one pair of extending arms, one of said arms being pivotally connected to an associated ram or cylinder for operating said sector pusher.

13. A furnace for thermal processing of solid fuel as defined in claim 12, wherein said shovel means comprises a generally flat blade or scraper pivotally connected to an associated ram or cylinder by means of an intermediate level having opposite ends thereof pivotally connected to said respective ram or cylinder and to said shovel means.

14. A furnace for thermal processing of solid fuel as defined in claim 13, further comprising linkage means pivotably connected to said shovel means and to said sector pusher.

15. A furnace for thermal processing of solid fuel as defined in claim 14, wherein said linkage means comprises a rod hingedly connected at its opposite ends to said shovel means and to said sector pusher and being of a predetermined length selected so that when the shovel means is shifted to an extreme position during its working stroke, it does not reach an exit edge of the bottom surface portion of said water seal means.

* * * * *